US011146020B2

(12) United States Patent
Watanabe et al.

(10) Patent No.: US 11,146,020 B2
(45) Date of Patent: Oct. 12, 2021

(54) WIRE HARNESS INCLUDING A CONNECTOR HOLDER

(71) Applicant: YAZAKI CORPORATION, Tokyo (JP)

(72) Inventors: Jin Watanabe, Shizuoka (JP); Naoyuki Yoshida, Shizuoka (JP); Shouya Shinogaya, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/550,176

(22) Filed: Aug. 24, 2019

(65) Prior Publication Data

US 2020/0106207 A1 Apr. 2, 2020

(30) Foreign Application Priority Data

Sep. 28, 2018 (JP) ..... JP2018-185123

(51) Int. Cl.

| | |
|---|---|
| ***H01R 12/00*** | (2006.01) |
| ***H01R 13/518*** | (2006.01) |
| ***H01R 13/514*** | (2006.01) |
| *H01R 107/00* | (2006.01) |
| *H01R 24/20* | (2011.01) |

(52) U.S. Cl.

CPC ..... *H01R 13/518* (2013.01); *H01R 13/514* (2013.01); *H01R 24/20* (2013.01); *H01R 2107/00* (2013.01)

(58) Field of Classification Search

CPC .. H01R 13/639; H01R 13/518; H01R 13/514; H01R 24/20; H01R 2107/00; H05K 7/026

USPC ..... 439/347, 540.1, 701, 76.2

See application file for complete search history.

(56) References Cited

U.S. PATENT DOCUMENTS 4,780,090 A * 10/1988 Sugiyama ..... H01R 13/631 439/247
4,923,411 A * 5/1990 Hayashi ..... H01R 13/518 439/540.1
4,990,094 A * 2/1991 Chandler ..... H01R 9/032 439/108
5,279,507 A * 1/1994 Kameyama ..... B60R 16/0222 439/270
5,308,255 A * 5/1994 Yamanashi ..... H01R 13/62955 439/157
5,328,388 A * 7/1994 Fust ..... H01R 13/514 439/364
5,367,126 A * 11/1994 Kikuchi ..... H01B 7/0045 174/135
5,551,885 A * 9/1996 Yamanashi ..... H01R 13/62933 439/157

(Continued)

FOREIGN PATENT DOCUMENTS

JP 2001-327037 A 11/2001
JP 2014-236623 A 12/2014
JP 2015-230873 A 12/2015

*Primary Examiner* — Thanh Tam T Le
(74) *Attorney, Agent, or Firm* — Kenealy Vaidya LLP

(57) ABSTRACT

A wire harness includes a first electric wire which is provided with a first connector at a tip end thereof and is branched form a trunk line, a second electric wire which is provided with a second connector to be connected to the first connector and is connected to the first electric wire via the first connector and the second connector, a connector holder configured to hold one of the first connector and the second connector.

9 Claims, 5 Drawing Sheets

(56) References Cited

U.S. PATENT DOCUMENTS 5,725,397 A * 3/1998 Fukamachi ..... H01R 13/514 439/701
5,975,933 A * 11/1999 Yamaguchi ..... B60R 15/02 439/247
6,022,247 A * 2/2000 Akiyama ..... B60R 16/0238 439/701
6,036,550 A * 3/2000 Naganawa ..... H01R 13/506 439/350
6,082,874 A * 7/2000 Huang ..... H01R 33/09 362/249.01
6,095,852 A * 8/2000 Gregory, II ..... H01R 13/506 439/466
6,116,951 A * 9/2000 Shu ..... F21V 19/0005 439/574
6,155,884 A * 12/2000 Sugiyama ..... H01R 13/516 439/701
6,259,027 B1 * 7/2001 Watanabe ..... B60R 16/0207 174/101
6,273,756 B1 * 8/2001 Ward ..... H01R 13/6592 439/372
6,341,881 B1 * 1/2002 Huang ..... F21V 19/0005 362/249.01
6,478,607 B2 * 11/2002 Tabata ..... H01R 13/5812 439/456
6,499,702 B2 * 12/2002 Kamekawa ..... B60R 16/0215 248/68.1
6,674,004 B2 * 1/2004 Ito ..... B60R 16/0215 174/135
6,844,496 B2 * 1/2005 Matsuda ..... B60R 16/0207 174/72 A
6,994,455 B2 * 2/2006 Okabe ..... B60Q 3/20 362/227
7,118,414 B2 * 10/2006 Spears ..... G06F 1/182 439/540.1
7,198,409 B2 * 4/2007 Smith ..... G02B 6/381 385/53
7,862,372 B2 * 1/2011 Chen ..... H01R 13/514 439/540.1
9,029,700 B2 * 5/2015 Hara ..... B60R 16/0215 174/68.1
10,096,401 B2 * 10/2018 Endo ..... B60R 16/0207
11,052,837 B2 * 7/2021 Watanabe ..... H01R 13/73
2003/0141878 A1 * 7/2003 Shinzou ..... G01R 31/60 324/539
2017/0057434 A1 3/2017 Nohara et al.
2020/0101911 A1 * 4/2020 Watanabe ..... H01B 7/0045

* cited by examiner

WIRE HARNESS INCLUDING A CONNECTOR HOLDER

CROSS-REFERENCE TO RELATED APPLICATIONS

This application is based on and claims priority under 35 USC 119 from Japanese Patent Application No. 2018-185123 filed on Sep. 28, 2018, the contents of which are incorporated herein by reference.

TECHNICAL FIELD

The present invention relates to a wire harness which includes a plurality of electric wires each provided with a connector at a tip end of the electric wire.

BACKGROUND ART

A wire harness mounted on a vehicle such as an automobile is generally configured as an assembly obtained by bundling, for example, a plurality of sub-harnesses respectively prepared for each system. The sub-harnesses to be bundled are prepared according to various required specification of the wire harness.

Specifically, there are a wide variety of electrical components to be mounted in vehicles corresponding to vehicle types, vehicle grades, and optional equipment (an acoustic system, a power window system, etc.) selected according to a demand of a vehicle customer (driver). Therefore, electric wires (circuit lines) configuring power supply lines, ground lines, signal lines, and communication lines which are to be connected to the various electrical components, are variously different. In order to cope with such differences in electric wires, a bundle of electric wires to be mounted standardly (standard circuit lines) is provided as a standard sub-harness so as to operate a drive system in units of the drive system such as an engine and a motor. Further, in order to operate optional equipment or the like to be selectively mounted, a bundle of electric wires (selection electric wires) to be mounted selectively and additionally is provided as an optional sub-harness.

In recent years, application of Information Technology (IT) to vehicles such as automatic driving technology and external environment detection technology is rapidly advancing, and both standard electric wires and selection electric wires are tending to increase with the introduction of IT. That is, the number of types (kind) of sub-harnesses that needs to be prepared in advance is increasing significantly when mounting wire harnesses in a vehicle.

Therefore, in order to reduce the increase in the number of types of sub-harnesses, it is known to construct a wire harness with a circuit substrate and a plurality of sub-harnesses by connecting the plurality of sub-harnesses to the circuit substrate and connecting the electric wires of each sub-harness to each other through a circuit pattern on the circuit substrate (for example, with reference to Patent Literature 1). In the type of wire harness, circuits such as branches can be provided in the circuit substrate for both the standard sub-harness and the optional sub-harness.

Patent Literature 1: JP-A-2015-230873

SUMMARY OF INVENTION

In the wire harness of Patent Literature 1 described above, there is no need to provide branches in both the standard sub-harness and the optional sub-harness by using the circuit substrate. Therefore, a shape of the sub-harness is simplified without branches and the whole system can be standardized.

Hobbies and diversions of vehicles for each customer are extremely detailed and are more and more diverse. Therefore, the increase in selection electric wires selectively added depending on the type and grade of a predetermined vehicle may be significant. In this case, routing of the optional sub-harness may be complicated, and it may be difficult to identify and take out only a desired optional sub-harness when performing maintenance after the routing. Even if a connector provided at a tip end of the electric wire of the optional sub-harness is connected to a mating connector, a plurality of electric wires may be arranged in an unstable state by hanging in the air.

The present invention is made in view of the above circumstances and an object thereof is to provide a wire harness capable of regulating movement of the connectors of the electric wires of the wire harness to arrange the plurality of electric wires stably while improving the maintainability after routing of the wire harness to enhance the work efficiency.

An object of the present invention is achieved by the following configurations.

(1) A wire harness includes:

a first electric wire which is provided with a first connector at a tip end thereof and is branched form a trunk line, a second electric wire which is provided with a second connector to be connected to the first connector and is to be connected to the first electric wire via the first connector and the second connector, and a connector holder configured to hold one of the first connector and the second connector.

(2) In the wire harness described in (1), a plurality of the first electric wires and the second electric wires are provided, the first electric wires are connected to the different second electric wires respectively, a plurality of the first connectors are fitted to a plurality of the second connectors respectively, and the connector holder is configured to hold a plurality of sets of fitted first connectors and second connectors.

(3) In the wire harness described in (2), either the plurality of first connectors or the plurality of second connectors are connected adjacent to each other, and the connector holder is configured to hold the plurality of connected first connectors or the plurality of connected second connectors.

(4) In the wire harness described in (3), either the plurality of first connectors or the plurality of second connectors are stacked in a height direction thereof, and are connected by engagement of engagement portions provided on mutually facing surfaces.

(5) In the wire harness described in (4), the engagement portion is constructed with a rib-shaped engagement protrusion or a slit-shaped engagement groove, and the engagement protrusion is inserted into the engagement groove, and thereby the plurality of first connectors or the plurality of second connectors are integrally connected.

According to the configuration of the wire harness in the above (1), since there is provided a connector holder for holding the first connector of the first electric wire and the second connector of the second electric wire which are fitted, a plurality of connectors can be concentrated in the connector holder to enhance the visibility of the connectors from the outside. Accordingly, the maintainability after routing can be improved to enhance the work efficiency. Since the plurality of connectors is held together in the connector holder, movement of the connectors of the electric wires of the wire harness can be regulated to stably arrange the plurality of electric wires.

According to the configuration of the wire harness in the above (2), since the connector holder holds a plurality of sets of fitted first and second connectors, even in a case of a plurality of electric wires, the plurality of electric wires can be stably arranged, and the routing of the wire harness can also be simplified.

According to the configuration of the wire harness in the above (3), since the connector holder holds the plurality of adjacently connected first connectors or second connectors, even in a case of a plurality of first or second connectors, the visibility of the plurality of connectors from the outside can be enhanced to further improve the maintainability after routing. The routing of the wire harness can also be simplified.

According to the configuration of the wire harness in the above (4), the plurality of first connectors or second connectors are stacked in the height direction, and are connected by engagement between the engagement portions provided on mutually facing surfaces. Therefore, even in a case where the plurality of electric wires are variously routed on a vehicle body, the visibility of the connectors from above the vehicle can be enhanced to further enhance the work efficiency of maintenance. Since the space occupancy rate of the connector holder along a horizontal surface of the vehicle body is reduced, the routing space of the wire harness on the vehicle body can be ensured, and the efficiency of routing operation can also be improved.

The wire harness according to the present invention includes the first electric wire which is provided with the first connector at the tip end thereof and is branched from the trunk line, the second electric wire which is provided with the second connector to be connected with the first connector and is to be connected to the first electric wire via the first connector and the second connector, and the connector holder configured to hold the fitted first connector and second connector. Therefore, a plurality of connectors can be concentrated in the connector holder to enhance the visibility of the connectors from the outside. Accordingly, the maintainability after routing can be improved to enhance the work efficiency. Since the plurality of connectors are held together in the connector holder, movement of the connectors of the electric wires of the wire harness can be regulated to stably arrange the plurality of electric wires.

The present invention has been briefly described above. Further, details of the present invention will be clarified by reading a mode (hereinafter, referred to as "embodiment") for carrying out the invention to be described below with reference to accompanying drawings.

DESCRIPTION OF EMBODIMENTS

Specific embodiments of the wire harness of the present invention will be described below with reference to each drawing.

Figure 1:
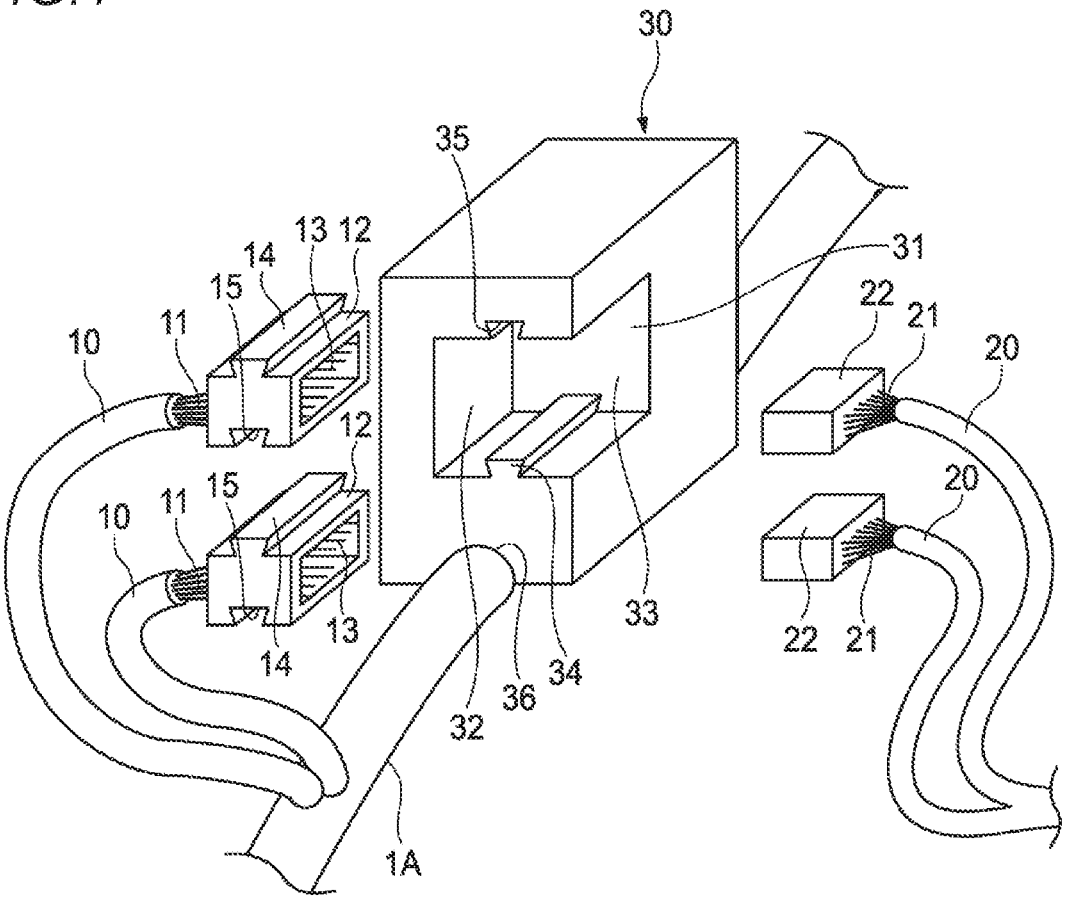
FIG. 1 is a perspective view illustrating a wire harness according to an embodiment of the present invention.
Figure 1:
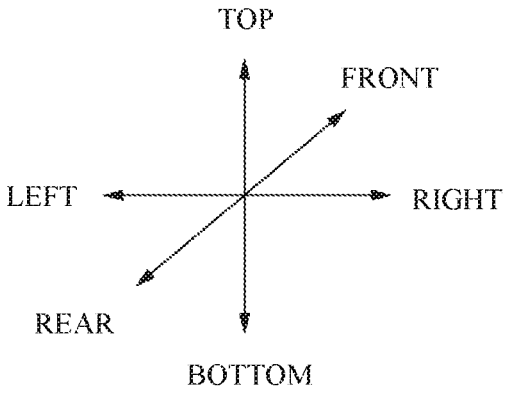
Figure 2:
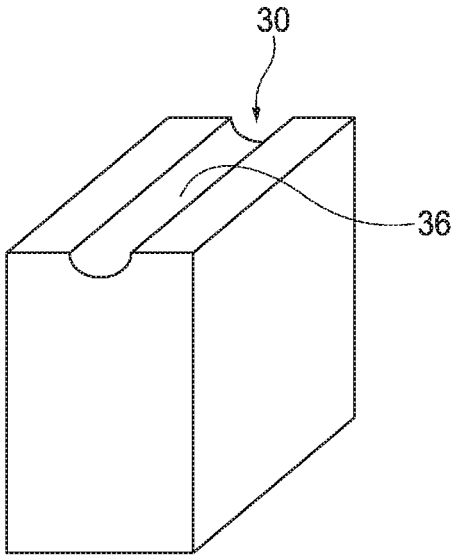
FIG. 2 is a perspective view showing a state where a connector holder shown in FIG. 1 is turned upside down.
Figure 3A:
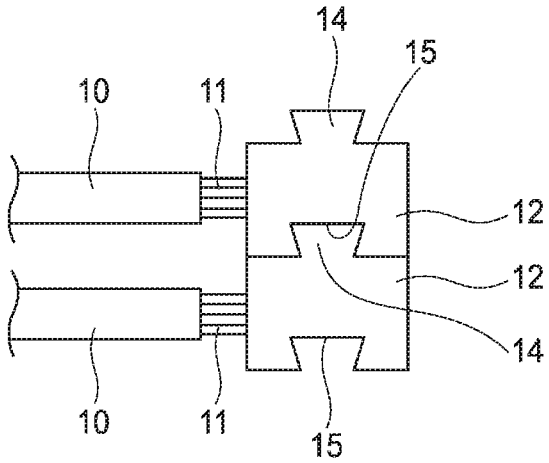
FIG. 3A is a side view illustrating a state where first connectors are stacked and engaged in a height direction thereof.
Figure 3B:
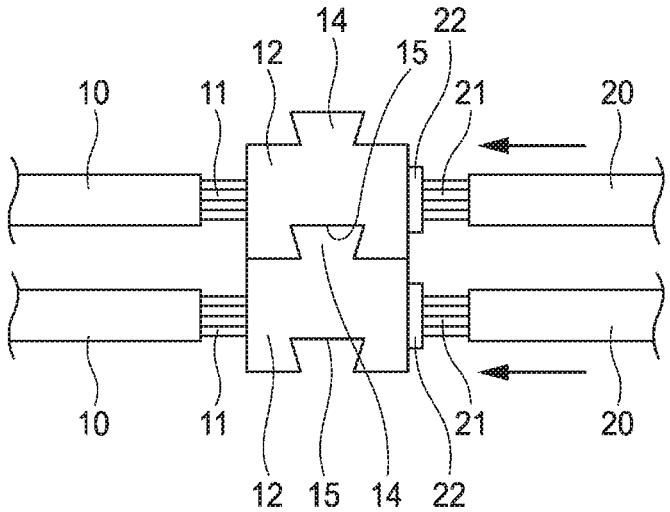
FIG. 3B is a side view illustrating a state where second connectors are fitted to the stacked and engaged first connectors.
Figure 4:
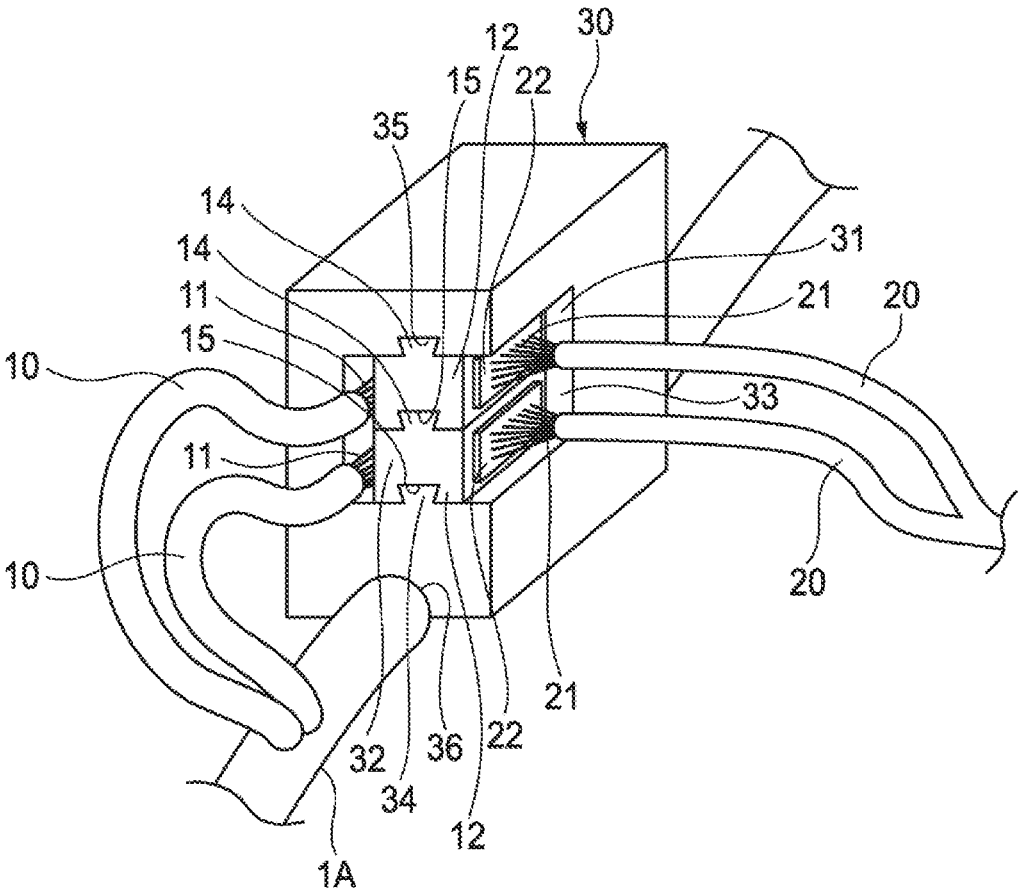
FIG. 4 is a perspective view illustrating a state where the connector holder shown in FIG. 1 is stacked and installed on a trunk line of the wire harness.
Figure 4:
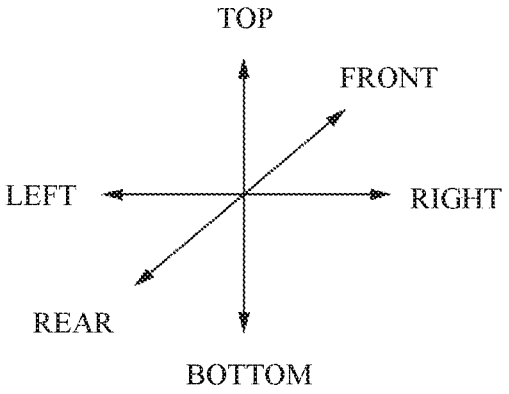

A wire harness 1 according to an embodiment of the present invention will be described with reference to FIGS. 1 to 4. FIG. 1 is a perspective view illustrating the wire harness 1 according to the embodiment of the present invention. FIG. 2 is a perspective view showing a state where a connector holder 30 shown in FIG. 1 is turned upside down. FIG. 3A is a side view illustrating a state where first connectors 12 are stacked and engaged in a height direction thereof. FIG. 3B is a side view illustrating a state where second connectors 22 are fitted to the stacked and engaged first connectors 12. FIG. 4 is a perspective view illustrating a state where the connector holder 30 shown in FIG. 1 is stacked and installed on a trunk line 1A of the wire harness 1.

(Overall Configuration of Wire Harness)

First, an overall configuration of the wire harness 1 of the present embodiment will be described.

As shown in FIGS. 1 to 4, the wire harness 1 of the present embodiment is to be mounted in a vehicle, such as an automobile, and includes the trunk line 1A and the connector holder 30. The trunk line 1A is to be disposed on a vehicle body, and the connector holder 30 is disposed and stacked on an upper side of the trunk line 1A. The wire harness 1 includes a standard sub-harness configured by a plurality of standard electric wires and an optional sub-harness configured by a plurality of selection electric wires. The standard sub-harness and the optional sub-harness are integrally bundled in the trunk line 1A, and the trunk line 1A is configured as an assembly including these sub-harnesses.

In the present embodiment, although the trunk line 1A of the wire harness 1 includes both the standard sub-harness and the optional sub-harness, the present invention is not limited thereto. The trunk line 1A may be configured only by the optional sub-harness.

The trunk line 1A is routed to extend in a vehicle front-rear direction. Two first electric wires 10 are branched from one side (rear side in FIGS. 1 and 4) of the trunk line 1A. Two second electric wire 20, which are to be connected to the first electric wires 10 via the first and second connectors 12, 22 (to be described later), are electric wires configuring a part of a sub-harness of another system connected to the trunk line 1A, that is, branch wires. The first and second electric wires 10, 20 includes a plurality of core wires 11, 21 such as stranded wires as conductors, and each of the plurality of core wires 11, 21 is covered at a periphery thereof with an electrically insulating synthetic resin or the like. In the present embodiment, the first electric wires 10 are drawn out from the optional sub-harness of the trunk line 1A. The second electric wires 20 are branch wires and are drawn out from the optional sub-harness of another system.

The optional sub-harness includes a plurality of selection electric wires, and in the present embodiment, the first and second electric wires 10, 20 are selection electric wires. Further, the standard sub-harness includes a plurality of standard electric wires. At least one of the plurality of standard electric wires and selection electric wires is an electric wire for supplying power, at least another one is a ground wire for grounding, and at least more anther one is a signal line or a communication line for transmitting a signal.

Further, many of the standard electric wires relate to basic functions of a vehicle, for example, a drive system such as an engine or a motor, and are electric wires which are mounted standardly on all vehicles. Meanwhile, many of the selection electric wires relate to additional (optional) functions of a vehicle, such as an acoustic system and a power window system, and are electric wires to be selectively mounted according to the demand of a vehicle customer (driver).

(Configuration of Connector of Electrical Wire)

Next, the connectors 12, 22 provided at the tip ends of the first and second electric wires 10, 20 will be described.

As shown in FIGS. 1, 3A, 3B and 4, the first connectors 12 are provided at the tip ends of the first electric wires 10, respectively. The first connector 12 is a female connector, and is formed substantially in a box shape by an electrically insulating synthetic resin or the like. The first electric wire 10 is connected to a side surface on one end (left side in FIGS. 1, 3A, 3B and 4) of the first connector 12 via the core wires 11 of the first electric wire 10. A side surface on the other end (right side in FIGS. 1, 3A, 3B and 4) to be fitted to the second connector 22 of the second electric wire 20 to be described later is formed to be open, and a plurality of conductive connection portions 13 are provided to be exposed. The plurality of connection portions 13 are electrically connected to the plurality of core wires 11 of the first electric wire 10, respectively.

On an upper surface of the first connector 12, a rib-shaped engagement protrusion 14 is provided to extend in a direction (width direction of the first connector 12) orthogonal to an opening direction of the side surface on the other end of the first connector 12, and a height direction (vertical direction) of the first connector 12. On a lower surface of the first connector 12, a slit-shaped engagement groove (engagement portion) 15 is provided to extend in the width direction of the first connector 12. The engagement groove 15 is formed corresponding to a shape of the engagement protrusion 14. The engagement protrusion 14 and the engagement groove 15 of the first connector 12 are disposed to be aligned with each other in the height direction of the first connector 12.

In the present embodiment, the engagement groove 15 is a dovetail groove, and the engagement protrusion 14 is provided as a corresponding tenon portion. Therefore, as to be described later, when the first connectors 12 are stacked and installed on one another in the height direction, the engagement protrusion 14 of one first connector 12 and the engagement groove 15 of the other (mating side) first connector 12 are fitted to each other in a dovetail groove structure. By the fitting, one first connector 12 and the other first connector 12 are integrally and firmly connected in a state of being adjacent to each other.

As long as the first connectors 12 can be connected adjacent to each other, the shapes of the engagement portions 14, 15 of the first connector 12 of the present embodiment are not limited thereto (dovetail groove structure). For example, the engagement portions 14, 15 of the first connector 12 may be formed in arc shapes corresponding to each other.

The second connectors 22 are provided at the tip ends of the two second electric wires 20, respectively. The second connector 22 is a male connector, and is formed in a flat box shape by an electrically insulating synthetic resin or the like. The second electric wire 20 is connected to a side surface on one end (right side in FIGS. 1, 2 and 4) of the second connector 22 via the core wires 21 of the second electric wire 20. A plurality of conductive connection-receiving portions (not shown) are provided on a side surface on the other end (left side in FIGS. 1, 2 and 4) of the second connector fitted to the first connector 12 of the first electric wire 10. The connection-receiving portions are electrically connected to the plurality of core wires 21 of the second electric wire 20 respectively.

Further, the second connector 22 of the second electric wire 20 is internally fitted in the first connector 12 of the first electric wire 10, and is connected to the first connector 12 in a state of being housed inside the first connector 12 of the first electric wire 10 (with reference to FIG. 3B). By the connection, the second electric wire 20 is electrically connected to the first electric wire 10 via the first and second connectors 12, 22.

(Configuration of Connector Holder)

Next, a configuration of the connector holder 30 will be described.

As shown in FIGS. 1, 2 and 4, the connector holder 30 is formed substantially in a box shape by an electrically insulating synthetic resin or the like. A part of side surfaces of the connector holder 30 defines a substantially box-shaped holding space 31 for holding a plurality of sets (two sets in the present embodiment) of fitted first and second connectors 12, 22 (to be described later) inside. The holding space 31 is formed by cutting two adjacent side surfaces of the connector holder 30 in a circumferential direction around a boundary of the two side surfaces. Therefore, in the holding space 31 of the connector holder 30, a first opening 32 is formed on a side surface on one side (rear side in FIGS. 1 and 4) of the two adjacent side surfaces, and a second opening 33 is formed on a side surface on the other side (right side in FIGS. 1 and 4). The first and second openings 32, 33 are in communication with each other in the circumferential direction.

On a lower surface of the holding space 31, an engagement protrusion (engagement portion) 34 corresponding to the engagement groove 15 of the first connector 12 is provided to extend in a direction orthogonal to the side surface on one side. On an upper surface of the holding space 31, an engagement groove (engagement portion) 35 facing the engagement protrusion 14 of the first connector 12 is similarly provided to extend in a direction orthogonal to the side surface on one side. The engagement protrusion 34 and the engagement groove 35 of the attachment 30 are similarly formed to be mutually engageable in a dovetail groove structure. The engagement protrusion 34 and the engagement groove 35 in the holding space 31 are arranged to be aligned with each other in the height direction of the connector holder 30.

When the two sets of fitted first and second connectors 12, 22 are held inside the holding space 31 of the connector holder 30, the connector holder 30 is provided such that a predetermined gap exists between side surfaces on one end of the first connectors 12 to which the first electric wires 10 are connected and a side wall of the holding space 31 facing the side surface. The first electric wire 10 is drawn around using the gap.

The shapes (dovetail groove structure) of the engagement portions 34, 35 of the holding space 31 of the present embodiment is not limited as long as the two sets of fitted first and second connectors 12, 22 can be engaged with and held by the holding space 31 of the connector holder 30. For example, the engagement portions may be formed in arc shapes corresponding to each other.

When the first and second connectors 12, 22 are engaged with the holding space 31 of the connector holder 30, the first connector 12 may be held in the holding space 31 of the connector holder 30 after the first connector 12 and the second connector 22 are fitted to each other. Meanwhile, the first connector 12 and the second connector 22 may be fitted after the first connector 12 is held in the holding space 31 of the connector holder 30.

Further, a housing groove 36 for housing the trunk line 1A therein is formed on one surface of the connector holder 30 facing the trunk line 1A, that is, on a back surface of the connector holder 30. A cross section of the housing groove 36 is formed in an arc shape with a predetermined gap with respect to a cross-sectional outer shape of the trunk line 1A.

The cross section of the housing groove 36 of the connector holder 30 may be formed substantially in a C shape such that a width of an opening of the housing groove 36 is smaller than a diameter of the arc. In this case, the trunk line 1A can be held stably inside the housing groove 36.

(Procedure for Attaching Connector to Connector Holder)

Next, a procedure for attaching the first and second connectors 12, 22 to the holding space 31 of the connector holder 30 will be described.

As shown in FIG. 3A, in the wire harness 1 configured as above, first, one first connector 12 and the other (mating) first connector 12 are stacked in the height direction. Then, the engagement protrusion 14 and the engagement groove 15 provided with surfaces facing each other are engaged and fixed with each other. Specifically, the engagement protrusion 14 on the upper surface of one first connector 12 is inserted into the engagement groove 15 on the lower surface of the other first connector 12 along an extending direction of the engagement groove 15. By the insertion, the two first connectors 12 are fitted in a dovetail groove structure and integrally connected in a state of being adjacent to each other in the height direction. Further, as shown in FIG. 3B, the second connectors 22 are respectively fitted to the first connectors 12 integrally connected in the adjacent state. By the fitting, the first electric wires 10 are electrically connected with the different electric wires 20 respectively via the first and second connectors 12, 22.

In the two sets of fitted and integrally connected first and second connectors 12, 22, as shown in FIG. 4, the engagement protrusion 14 of the first connector 12 which is positioned on an uppermost surface in a state where the first connectors 12 are stacked is inserted into the engagement groove 35 on the upper surface on the holding space 31 along the extending direction. Simultaneously with the insertion, the engagement groove 15 of the first connector 12 which is positioned at a lowermost surface is similarly inserted into the engagement protrusion 34 on the lower surface of the holding space 31 along the extending direction. Simultaneously with the insertion, the connector holder 30 houses and firmly holds the two sets of fitted first and second connectors 12, 22 inside the holding space 31 of the connector holder 30. At this time, the first electric wires 10 are routed to pass through a gap between side surfaces on one end of the stacked and disposed first connectors 12 and a side wall of the holding space 31, and the first opening 32 of the holding space 31. The second electric wires 20 are routed to pass through the second opening 33 of the holding space 31.

(Advantage of Wire Harness of Embodiment)

As described above, the wire harness 1 according to the present embodiment includes the first electric wires 10 each being provided with the first connector 12 at the tip end thereof and being branched from the trunk line 1A, the second electric wires 20 each being provided with the second connector 22 to be connected with the first connector 12 and to be connected to the first electric wires 10 via the first connectors 12 and the second connectors 22, and the connector holder 30 for holding the fitted first connectors 12 and second connectors 22. Therefore, a plurality of connectors 12, 22 can be concentrated in the connector holder 30 to enhance the visibility of the connectors 12, 22 from the outside. Accordingly, the maintainability after routing can be improved to enhance the work efficiency. Since the plurality of connectors 12, 22 are held together in the connector holder 30, movement of the connectors 12, 22 of the electric wires 10, 20 of the wire harness 1 can be regulated to stably arrange the plurality of electric wires 10, 20.

According to the wire harness 1 of the present embodiment, the connector holder 30 holds a plurality of sets (two sets in the present embodiment) of fitted first connectors 12 and second connectors 22. Therefore, even in a case of a plurality of electric wires 10, 20, the plurality of electric wires 10, 20 can be stably disposed, and the routing of the wire harness 1 can also be simplified.

According to the wire harness 1 of the present embodiment, the connector holder 30 holds a plurality of adjacently connected first connectors 12. Therefore, even in a case of a plurality of the first and second connectors 12, 22, the visibility of the plurality of connectors 12, 22 from the outside can be enhanced, and the manageability after routing can be further improved. The routing of the wire harness 1 can also be simplified.

According to the wire harness 1 of the present embodiment, a plurality of first connectors 12 are stacked in the height direction, and are connected by engagement between the engagement portions (engagement protrusions and engagement grooves) 14, 15 provided on mutually facing surfaces. Therefore, even in a case where the plurality of electric wires 10, 20 are variously routed on a vehicle body, the visibility of the connectors 12, 22 from above the vehicle can be enhanced to further enhance the work efficiency of maintenance. Since the space occupancy rate of the connector holder 30 along a horizontal surface of the vehicle body is reduced, the routing space of the wire harness 1 on the vehicle body can be ensured, and the efficiency of routing operation can also be improved.

Figure 5:
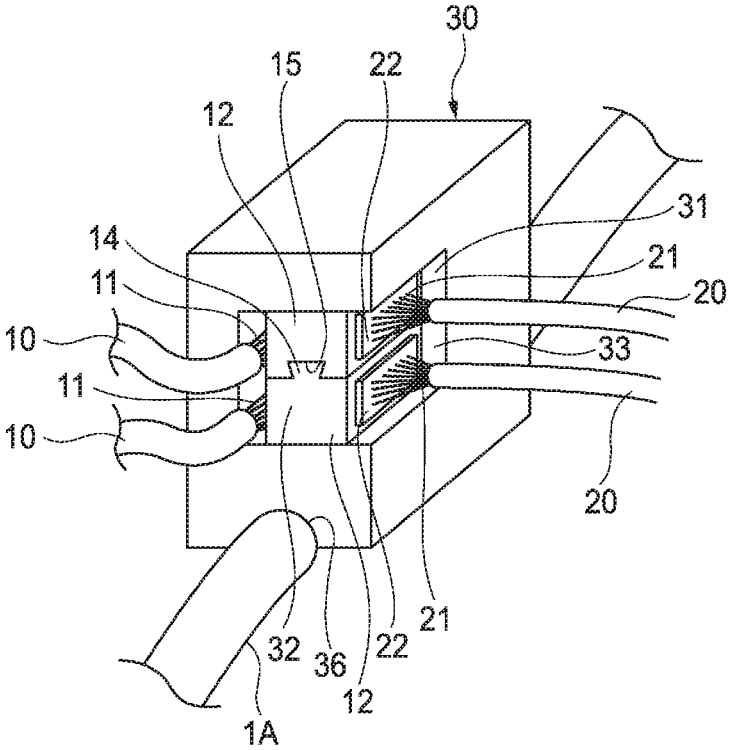
FIG. 5 is a perspective view illustrating a modification of the present invention.

Further, as shown in FIG. 5, in a modification of the present embodiment, the engaging protrusion 34 and the engaging groove 35 are not provided in the holding space 31 of the connector holder 30, and the upper and lower surfaces of the holding space 31 are formed to be flat. Corresponding to the flat shape, the engagement protrusion 14 and the engagement groove 15 are not similarly provided on the uppermost surface and the lowermost surface in a state where the two first connectors are stacked. In this case, the two sets of fitted first and second connectors 12, 22 are held and fixed inside the holding space 31 in an upper-lower direction (height direction). That is, the engagement portions 34, 35 may not be provided in the holding space 31 of the connector holder 30 as in the present modification, as long as the first and second connectors 12, 22 can be engaged and held stably inside the holding space 31.

Although the description of the specific embodiments is completed above, aspects of the present invention are not limited to these embodiments, and may be appropriately modified, improved, or the like.

Here, characteristics of the embodiments of the wire harness 1 according to the present invention described above are summarized briefly in the following [1] to [4], respectively.

[1] A wire harness (1) includes a first electric wire (10) which is provided with a first connector (12) at a tip end thereof and is branched form a trunk line (1A), a second electric wire (20) which is provided with a second connector (22) to be connected to the first connector (12) and is to be connected to the first electric wire (10) via the first connector (12) and the second connector (22), and a connector holder (30) configured to hold one (12) of the first connector (12) and the second connector (22).

[2] In the wire harness (1) described in [1], a plurality of the first electric wires (10) and the second electric wires (20) are provided, the different second electric wires (20) are connected to the first electric wires (10) respectively, a plurality of the first connectors (12) are fitted to a plurality of the second connectors (22) respectively, and the connector holder (30) is configured to hold a plurality of sets of fitted first connectors (12) and second connectors (22).

[3] In the wire harness (1) described in [2], either the plurality of first connectors (12) or the plurality of second connectors (22) are connected adjacent to each other, and the connector holder (30) is configured to hold the plurality of connected first connectors (12) or the plurality of connected second connectors (22).

[4] In the wire harness (1) described in [3], either the plurality of first connectors (12) or the plurality of second connectors (22) are stacked in a height direction thereof, and are connected by engagement between engagement portions (engagement protrusion 14 and engagement groove 15) provided on mutually facing surfaces.

[5] In the wire harness (1) described in [4], the engagement portion is constructed with a rib-shaped engagement protrusion (14) or a slit-shaped engagement groove (15), and the engagement protrusion (14) is inserted into the engagement groove (15), and thereby the plurality of first connectors (12) or the plurality of second connectors (22) are integrally connected.

What is claimed is:

1. A wire harness comprising:

a trunk line, a first electric wire which is provided with a first connector at a tip end of the first electric wire and is branched from the trunk line, a second electric wire which is provided with a second connector to be connected to the first connector and is connected to the first electric wire via the first connector and the second connector, a connector holder having a holding space for holding the first connector, wherein the first connector includes a first rib-shaped engagement protrusion and a first slit-shaped engagement groove, the connector holder includes one of a second rib-shaped engagement protrusion and a second slit-shaped engagement groove that directly engages one of the first slit-shaped engagement groove and the first rib-shaped engagement protrusion of the first connector, respectively, the holder includes a first side surface and a second side surface that abuts the first side surface at an angle and extends away from the first side surface, and the first side surface has a first opening and the second side surface has a second opening, and the first and second openings are in communication with each other in a circumferential direction, and the first electric wire is routed to pass through the first opening and the second electric wire is routed to pass through the second opening.

2. The wire harness according to claim 1, wherein a third electric wire is provided with a third connector at a tip end of the third electric wire and is branched from the trunk line, a fourth electric wire is provided with a fourth connector to be connected to the third connector and is connected to the third electric wire via the third connector and the fourth connector, and the connector holder is configured to hold the first connector fitted with the second connector and the third connected fitted with the fourth connector.

3. The wire harness according to claim 2, wherein the first connector and the third connector are connected adjacent to each other, and the connector holder is configured to hold the first connector and the third connector connected adjacent to each other.

4. The wire harness according to claim 3, wherein the first connector and the third connector are stacked in a height direction thereof, and are connected by engagement of engagement portions provided on mutually facing surfaces of the first connector and the third connector.

5. The wire harness according to claim 4, wherein the engagement portions include one of a rib-shaped engagement protrusion and a slit-shaped engagement groove on the third connector that is different from the one of the second rib-shaped engagement protrusion and the second slit-shaped engagement groove of the holder, and the one of the engagement protrusion and the engagement groove of the third connector engages a respective one of the first engagement groove and the first engagement protrusion of the first connector, and thereby the first connector and the third connector are integrally connected.

6. The wire harness according to claim 2, wherein the second connector and the fourth connector are connected adjacent to each other, and the connector holder is configured to hold the second connector and the fourth connector connected adjacent to each other.

7. The wire harness according to claim 2, wherein the third connector includes a third rib-shaped engagement protrusion and a third slit-shaped engagement groove, and the third rib-shaped engagement protrusion slidably engages with the first slit-shaped engagement groove of the first connector.

8. The wire harness according to claim 7, wherein the connector holder has each the second rib-shaped engagement protrusion and the second slit-shaped engagement groove, the second rib-shaped engagement protrusion of the connector holder slidably engages with the third slit-shaped engagement groove of the third connector, and the second slit-shaped engagement groove of the connector holder slidably engages with the first rib-shaped engagement protrusion of the first connector.

9. The wire harness according to claim 1, wherein the connector holder is configured to engage the trunk line adjacent to a location from which the first electric wire is branched from the trunk line.

* * * * *